US009096076B2

(12) United States Patent
Hanamoto

(10) Patent No.: US 9,096,076 B2
(45) Date of Patent: Aug. 4, 2015

(54) PRINTING SYSTEM

(71) Applicant: Riso Kagaku Corporation, Tokyo (JP)

(72) Inventor: Yoshihiro Hanamoto, Tsukuba (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 14/496,340

(22) Filed: Sep. 25, 2014

(65) Prior Publication Data

US 2015/0091968 A1 Apr. 2, 2015

(30) Foreign Application Priority Data

Sep. 30, 2013 (JP) ..... 2013-203060

(51) Int. Cl.
*B41J 29/38* (2006.01)
*B41J 13/00* (2006.01)

(52) U.S. Cl.
CPC ..... *B41J 13/0009* (2013.01); *B41J 13/0036* (2013.01)

(58) Field of Classification Search
CPC ..... B41J 13/0009; B41J 13/0036
See application file for complete search history.

(56) References Cited

U.S. PATENT DOCUMENTS

2009/0284560 A1* 11/2009 Takahashi ..... 347/16
2014/0138217 A1* 5/2014 Hashimoto ..... 198/788

FOREIGN PATENT DOCUMENTS

JP 2006-248766 A 9/2006

* cited by examiner

*Primary Examiner* — Julian Huffman
(74) *Attorney, Agent, or Firm* — Studebaker & Brackett PC

(57) ABSTRACT

When a printing conveyance speed at a printing unit is changed, if a length of a printing paper sheet in the conveyance direction thereof is smaller than an inter-unit conveyance distance, which is set in advance, between the printing unit and a post-processing unit, only a printing suspending operation at the printing unit is performed, and a post-processing suspending operation at the post-processing unit is not performed. On the other hand, if the length of the printing paper sheet in the conveyance direction thereof is equal to or greater than the inter-unit conveyance distance, both the printing suspending operation at the printing unit and the post-processing suspending operation at the post-processing unit are performed. In this manner, the post-processing suspending operation is omitted depending on the length of the printing paper sheet in the conveyance direction thereof.

6 Claims, 5 Drawing Sheets

| TYPE OF PRINTING PAPER SHEET | MAXIMUM DROP NUMBER |
|---|---|
| SHEET A | 5 |
| SHEET B | 6 |
| SHEET C | 6 |
| SHEET D | 7 |

FIG.4

| MAXIMUM DROP NUMBER | PRINT RESOLUTION (dpi) | PRINTING CONVEYANCE SPEED |
|---|---|---|
| 5 | 300 | v1 |
| | 600 | v2 |
| 6 | 300 | v3 |
| | 600 | v4 |
| 7 | 300 | v5 |
| | 600 | v6 |

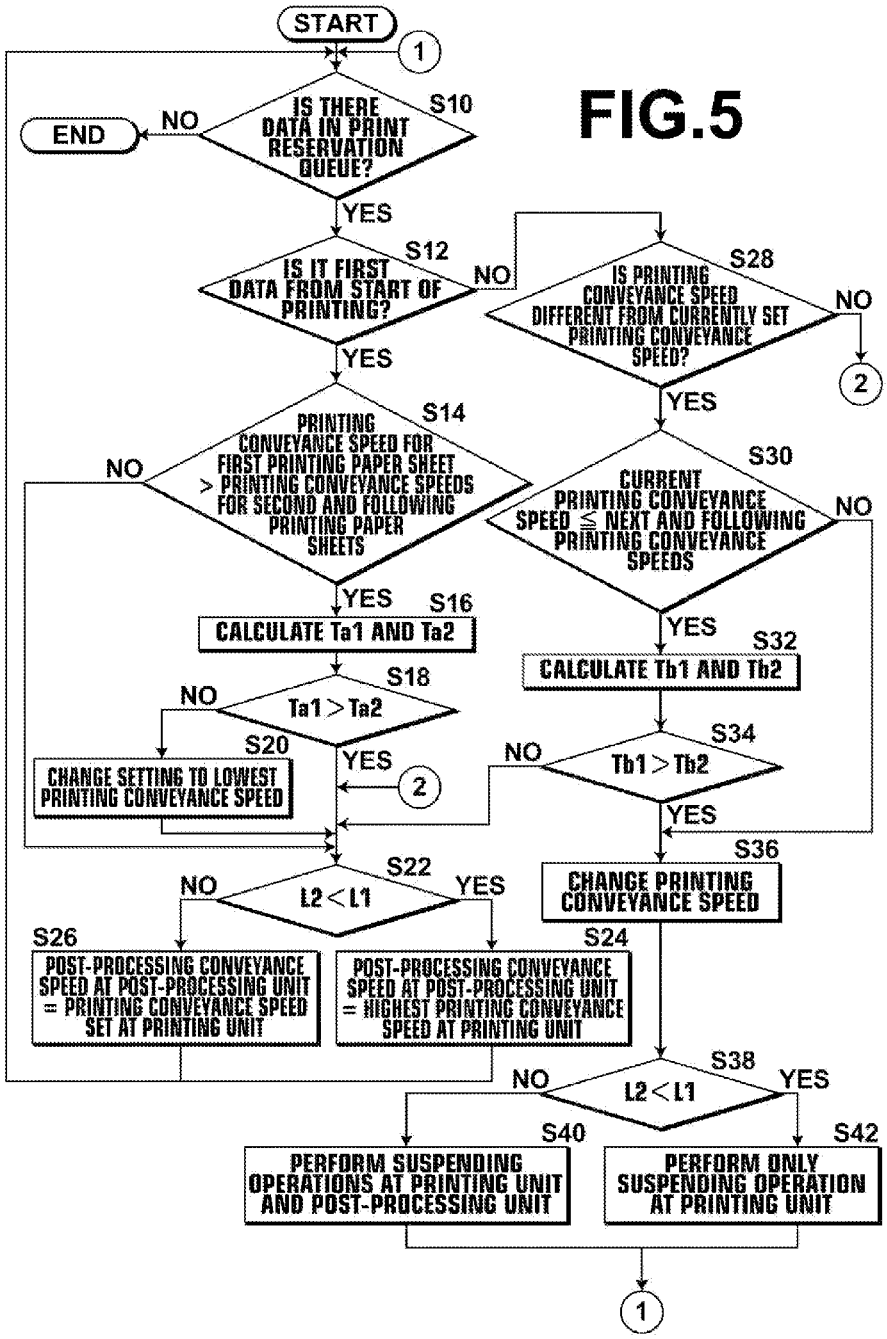
FIG.5
START
1
S10
IS THERE DATA IN PRINT RESERVATION QUEUE?
NO
END
YES
S12
IS IT FIRST DATA FROM START OF PRINTING?
NO
YES
S14
PRINTING CONVEYANCE SPEED FOR FIRST PRINTING PAPER SHEET > PRINTING CONVEYANCE SPEEDS FOR SECOND AND FOLLOWING PRINTING PAPER SHEETS
NO
YES
S16
CALCULATE Ta1 AND Ta2
S18
Ta1 > Ta2
NO
S20
CHANGE SETTING TO LOWEST PRINTING CONVEYANCE SPEED
YES
2
S22
L2 < L1
NO
YES
S26
POST-PROCESSING CONVEYANCE SPEED AT POST-PROCESSING UNIT = PRINTING CONVEYANCE SPEED SET AT PRINTING UNIT
S24
POST-PROCESSING CONVEYANCE SPEED AT POST-PROCESSING UNIT = HIGHEST PRINTING CONVEYANCE SPEED AT PRINTING UNIT
S28
IS PRINTING CONVEYANCE SPEED DIFFERENT FROM CURRENTLY SET PRINTING CONVEYANCE SPEED?
NO
2
YES
S30
CURRENT PRINTING CONVEYANCE SPEED ≦ NEXT AND FOLLOWING PRINTING CONVEYANCE SPEEDS
NO
YES
S32
CALCULATE Tb1 AND Tb2
S34
Tb1 > Tb2
NO
YES
S36
CHANGE PRINTING CONVEYANCE SPEED
S38
L2 < L1
NO
YES
S40
PERFORM SUSPENDING OPERATIONS AT PRINTING UNIT AND POST-PROCESSING UNIT
S42
PERFORM ONLY SUSPENDING OPERATION AT PRINTING UNIT
1

PRINTING SYSTEM

CROSS-REFERENCE TO RELATED APPLICATIONS

The present application claims priority under 35 U.S.C. §119 to Japanese Patent Application No. 2013-203060, filed on Sep. 30, 2013. The above application is hereby expressly incorporated by reference, in its entirety, into the present application.

BACKGROUND OF THE INVENTION

1. Field of the Invention

The present invention relates to a printing system including a printing unit that performs printing on a printing medium, and a post-processing unit that performs given post-processing on the printed printing medium having been subjected to printing at the printing unit.

2. Description of the Related Art

In recent years, printing systems including a post-processing unit, which is connected downstream a printing unit to perform various types of post-processing on printed paper sheets having been subjected to printing at the printing unit, have been proposed. Examples of the post-processing performed by the post-processing unit may include inserting and sealing processing, stapling processing, punching processing, etc.

When a printed paper sheet discharged from the printing unit is received by the post-processing unit located downstream the printing unit in such a printing system, even in a case where, for example, the leading edge of the printed paper sheet is in the post-processing unit and the trailing edge of the printed paper sheet is in the printing unit such that the printed paper sheet is conveyed by both the units, the conveyance speed of the printing paper sheet at the printing unit and the conveyance speed of the printing paper sheet at the post-processing unit are set at almost the same speed so that the post-processing unit can smoothly receive the printed paper sheet (see, Japanese Unexamined Patent Publication No. 2006-248766 (Patent Document 1)).

SUMMARY OF THE INVENTION

In a case where printing is continuously performed on a plurality of printing paper sheets and post-processing is performed on the printed paper sheets in the printing system as described above, different conveyance speeds may be set for individual printing paper sheets.

For example, in a case where the printing unit is an inkjet printer, the plurality of printing paper sheets may be of different types, and a maximum ink drop number may be set depending on the type of each printing paper sheet. Specifically, in a case where the post-processing is inserting and sealing processing, different maximum ink drop numbers may be set for a printing paper sheet for envelope and a printing paper sheet for letter. In this case, the conveyance speed for the printing paper sheet for envelope and the conveyance speed for the printing paper sheet for letter are set at different conveyance speeds depending on the maximum ink drop number, and it is necessary to change the conveyance speed during a series of operations.

When the conveyance speed for printing paper sheets at the printing unit is changed, a suspending operation to once suspend feeding of printing paper sheets and discharge any printed paper sheet in the printing unit to change setting of the conveyance speed is performed.

Then, in this case, conventionally, a suspending operation is also performed at the post-processing unit to discharge any printed paper sheet in the unit to change setting of the conveyance speed, etc., in order to change the conveyance speed of printed paper sheets along with the change of the conveyance speed at the printing unit.

However, when the suspending operation is performed at the post-processing unit as described above, it is necessary to stop feeding of the next printing paper sheet until the printed paper sheets are discharged from the post-processing unit and a restart operation to change setting of the conveyance speed is finished, and this results in low productivity.

In view of the above-described circumstances, the present invention is directed to providing a printing system that includes a printing unit and a post-processing unit and can achieve higher productivity.

An aspect of the printing system of the invention is a printing system comprising a printing unit and a post-processing unit, the printing unit comprising: a feeding section that feeds a printing medium; a printing medium conveyance section that receives and conveys the printing medium fed by the feeding section; a printing section that performs printing on the printing medium conveyed by the printing medium conveyance section; and a printing control section that controls the printing medium conveyance section such that each printing medium is conveyed at a printing conveyance speed set for each printing medium, and performs, when the printing conveyance speed is changed, a printing suspending operation to suspend feeding of the printing medium from the feeding section, to discharge an already fed printing medium, and to change setting of the printing conveyance speed, the post-processing unit comprising: a printed printing medium conveyance section that receives and conveys a printed printing medium having been subjected to the printing; a post-processing section that performs given post-processing on the printed printing medium conveyed by the printed printing medium conveyance section; and a post-processing control section that controls a post-processing conveyance speed of the printed printing medium conveyance section such that the printed printing medium is received by the printed printing medium conveyance section at the same speed as the printing conveyance speed at the printing unit, and performs, when the printing conveyance speed at the printing unit is changed, a post-processing suspending operation to discharge the printed printing medium and to change setting of the post-processing conveyance speed, wherein, when the printing conveyance speed at the printing unit is changed, the post-processing control section does not perform the post-processing suspending operation if a length of the printing medium in a conveyance direction thereof is smaller than an inter-unit conveyance distance, which is set in advance, between the printing unit and the post-processing unit, and the post-processing control section performs the post-processing suspending operation if the length of the printing medium in the conveyance direction thereof is equal to or greater than the inter-unit conveyance distance.

In the above-described printing system of the invention, the printing control section may be configured such that, if the printing conveyance speed for a currently set printing medium differs from the printing conveyance speed set for a next printing medium to be conveyed, the printing control section compares a first estimated entire printing time, which is estimated on the assumption that the printing conveyance speed for the next and the following printing media to be conveyed is not changed from the printing conveyance speed for the currently set printing medium, with a second estimated entire printing time including a time taken for the printing suspending operation, which is estimated on the assumption that the printing conveyance speed for the next and the following printing media to be conveyed is changed from the printing conveyance speed for the currently set printing medium, and the printing control section performs the printing suspending operation if the second estimated entire printing time is smaller than the first estimated entire printing time, and the printing control section does not perform the printing suspending operation and does not change the printing conveyance speed from the printing conveyance speed for the currently set printing medium if the first estimated entire printing time is not greater than the second estimated entire printing time.

Further, the post-processing control section may be configured such that, if the length of the printing medium in the conveyance direction thereof is equal to or greater than the inter-unit conveyance distance, the post-processing control section sets the post-processing conveyance speed at the same speed as the printing conveyance speed, and if the length of the printing medium in the conveyance direction thereof is smaller than the inter-unit conveyance distance, the post-processing control section sets the post-processing conveyance speed at a speed higher than the printing conveyance speed set for the printing medium.

Further, the post-processing control section may be configured such that, if the length of the printing medium in the conveyance direction thereof is smaller than the inter-unit conveyance distance, the post-processing control section sets the post-processing conveyance speed at the same speed as a highest printing conveyance speed that can be set at the printing medium conveyance section.

According to the printing system of the invention, when the printing conveyance speed at the printing unit is changed, if the length of the printing medium in the conveyance direction thereof is smaller than the inter-unit conveyance distance, which is set in advance, between the printing unit and the post-processing unit, there is no moment at which the leading edge of the printed printing medium is conveyed by the post-processing unit and the trailing edge of the printed printing medium is conveyed by the printing unit at the same time, and it is necessary to change the post-processing conveyance speed at the post-processing unit regardless of the change of the printing conveyance speed at the printing unit, and the post-processing suspending operation is not performed. On the other hand, if the length of the printing medium in the conveyance direction thereof is equal to or greater than the inter-unit conveyance distance, i.e., if there is a moment at which the leading edge of the printed printing medium is conveyed by the post-processing unit and the trailing edge of the printed printing medium is conveyed by the printing unit at the same time, the post-processing suspending operation is performed. This allows omitting the post-processing suspending operation depending on the length of the printing paper sheet in the conveyance direction thereof, thereby improving productivity. Specifically, in the case where the post-processing suspending operation is omitted, the entire processing time can be reduced at least by a time taken for discharging the printed paper sheet from the post-processing unit and a restart time for changing setting of the post-processing conveyance speed.

Further, in the above-described printing system of the invention, if the printing conveyance speed for the currently set printing medium differs from the printing conveyance speed set for the next printing medium to be conveyed, comparison may be made between the first estimated entire printing time, which is estimated on the assumption that the printing conveyance speed for the next and the following printing media to be conveyed is not changed from the printing conveyance speed for the currently set printing medium, and the second estimated entire printing time including a time taken for the printing suspending operation, which is estimated on the assumption that the printing conveyance speed for the next and the following printing media to be conveyed is changed from the printing conveyance speed for the currently set printing medium. Then, the printing suspending operation may be performed if the second estimated entire printing time is smaller than the first estimated entire printing time, and the printing suspending operation may not be performed and printing conveyance speed may not be changed from the printing conveyance speed for the currently set printing medium if the first estimated entire printing time is equal to or smaller than the second estimated entire printing time. In this case, further reduction of the entire processing time can achieved.

Further, the post-processing conveyance speed may be set at the same speed as the printing conveyance speed if the length of the printing medium in the conveyance direction thereof is equal to or greater than the inter-unit conveyance distance, and the post-processing conveyance speed may be set at a higher speed than the printing conveyance speed for the printing medium if the length of the printing medium in the conveyance direction thereof is smaller than the inter-unit conveyance distance. In this case, speed-up of the post-processing can be achieved, thereby achieving further reduction of the entire processing time.

BRIEF DESCRIPTION OF THE DRAWINGS

FIG. 4 shows one example of a printing conveyance speed table, FIG. 5 is a flow chart for explaining operation of one embodiment of the printing system of the invention.

DESCRIPTION OF THE PREFERRED EMBODIMENTS

Figure 1:
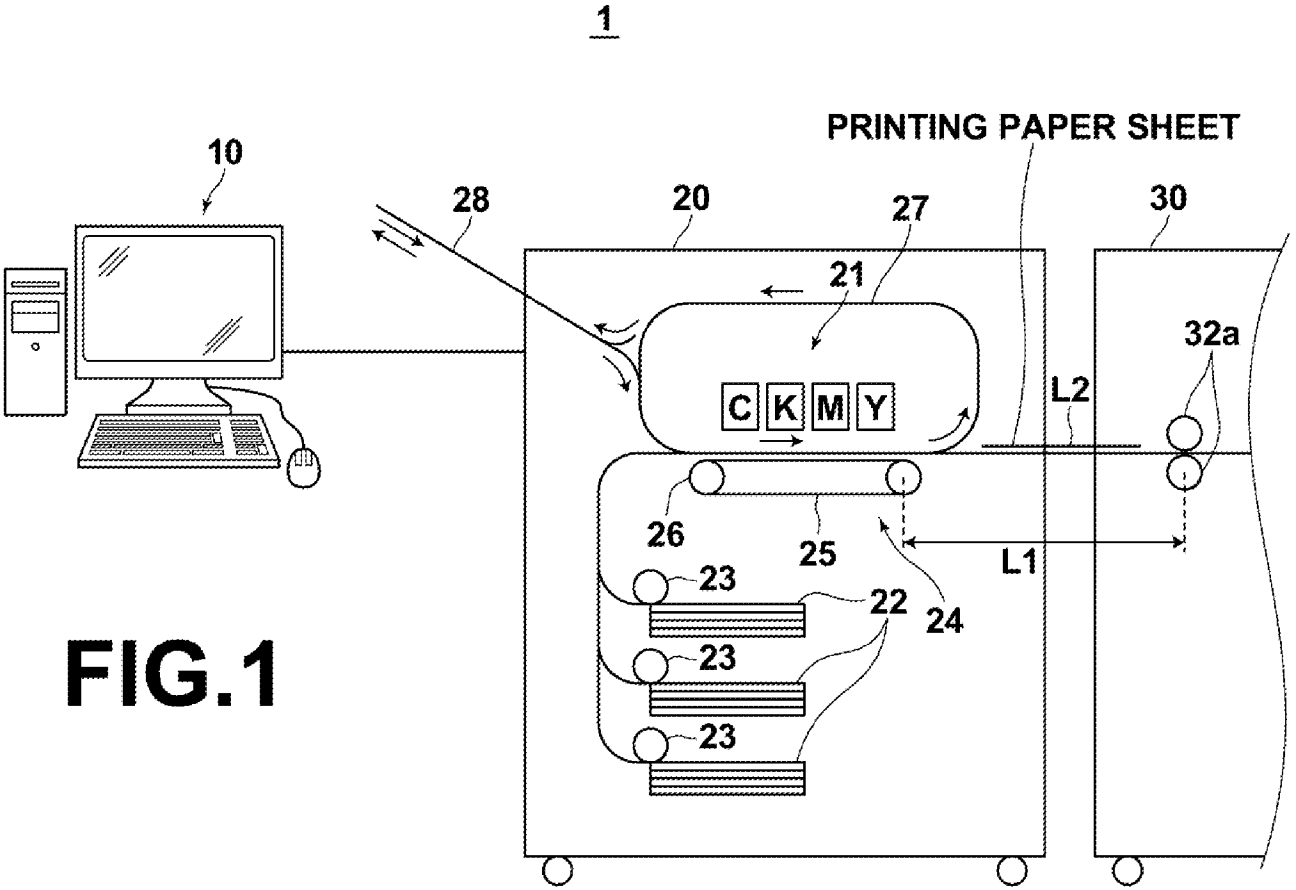
FIG. 1 is the entire schematic configuration of one embodiment of a printing system of the present invention.

Hereinafter, one embodiment of a printing system of the present invention will be described in detail with reference to the drawings. The printing system of this embodiment is characterized by the control that is exerted when a printing conveyance speed set for each printing paper sheet is changed. First, the entire structure of the system is described. FIG. 1 is a schematic structural diagram of the entire printing system 1 of this embodiment.

As shown in FIG. 1, the printing system 1 of this embodiment includes: a computer 10; a printing unit 20 connected to the computer 10 via a network, such as a wired or wireless LAN; and a post-processing unit 30 that performs post-processing on printing paper sheets having been subjected to printing at the printing unit 20.

The computer 10 is configured to be capable of editing image data to be printed on printing paper sheets. The computer 10 generates print job data including the image data and outputs the print job data to the printing unit 20. The print job data includes image data for one or more pages which correspond to one or more printing paper sheets, respectively, and may include, besides the image data, information indicating the type of each printing paper sheet, information indicating the size of each printing paper sheet, print resolution, information indicating duplex printing or simplex printing, information of the content of post-processing, etc.

The printing unit 20 performs printing on each printing paper sheet based on the print job data outputted from the computer 10. The printing unit 20 includes an ink head section 21 (which corresponds to a printing section) that ejects ink onto each printing paper sheet. The ink head section 21 achieves printing by ejecting ink onto each printing paper sheet based on the image data in the print job data outputted from the computer 10. The ink head section 21 of this embodiment includes a plurality of line-type ink heads for ejecting inks of different colors, such as black K, cyan C, magenta M and yellow Y.

The printing unit 20 also includes paper feeding trays 22 on which printing paper sheets are placed, and a paper feeding section 23 (which corresponds to a feeding section) that picks up and feeds each printing paper sheet placed on any of the paper feeding trays 22. Various types and/or sizes of printing paper sheets are placed on the paper feeding trays 22. When printing is performed at the printing unit 20, each printing paper sheet placed on any of the paper feeding trays 22 is picked up by the paper feeding section 23 provided with pick rollers, or the like, and fed to a paper conveyance section 24 (which corresponds to a printing medium conveyance section).

The paper conveyance section 24 is formed by a conveying belt 25 for conveying each printing paper sheet fed from the paper feeding tray 22, a belt motor 26 for moving the conveying belt 25, a circulating conveyance path 27, etc., and conveys each printing paper sheet, which is fed from any of the paper feeding trays 22, from the upstream side to the downstream side of the ink head section 21.

In the case of simplex printing, the paper conveyance section 24 passes each printing paper sheet with one side having been subjected to printing at the ink head section 21 to the post-processing unit 30. In the case of duplex printing, the paper conveyance section 24 conveys each one side printed paper sheet to an inverting section 28, and conveys the one side printed paper sheet inverted at the inverting section 28 again from the upstream side to the downstream side of the ink head section 21. Thereafter, the paper conveyance section 24 passes each printing paper sheet with the other side having been subjected to printing at the ink head section 21 (and thus the both sides having been subjected to printing) to the post-processing unit 30.

The post-processing unit 30 performs given post-processing on the printed paper sheets passed from the printing unit 20. Examples of the post-processing performed by the post-processing unit 30 may include stapling processing to fasten a plurality of printed paper sheets with a staple, offset processing to output each set of printed paper sheets onto the paper output tray at an offset position from the previous set, punching processing to punch the printed paper sheet(s), folding processing to fold the printed paper sheet(s) in three, in two, etc., inserting and sealing processing to insert and seal the folded printed paper sheet(s) into a printing paper sheet for envelope, and bookbinding processing to perform bookbinding using the printed paper sheets. As specific mechanisms for achieving these types of post-processing, known mechanisms can be used, and detailed descriptions thereof are omitted.

Next, a control system of the printing system 1 of this embodiment is described with reference to FIG. 2.

Figures 2, 3:
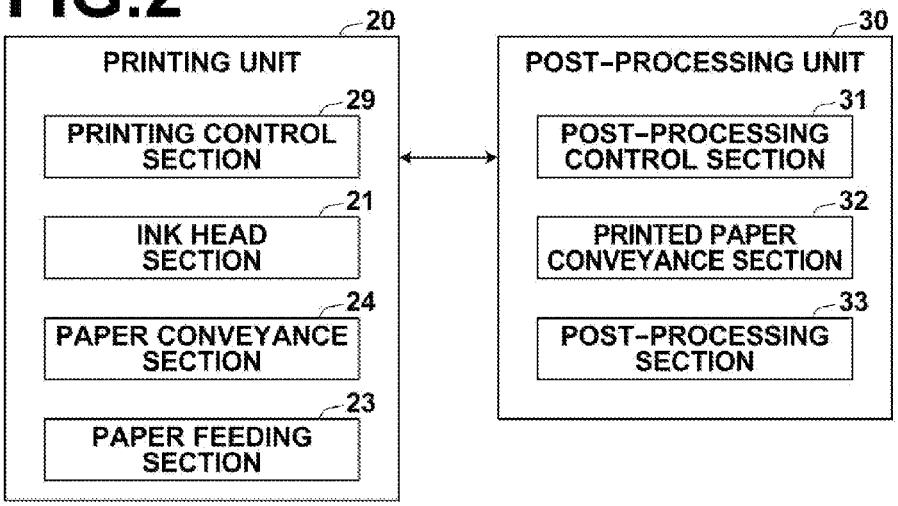
FIG. 2 is a block diagram showing part of a control system of the printing system shown in FIG. 1.
FIG. 3 shows one example of a maximum drop number table.

As shown in FIG. 2, the printing unit 20 includes a printing control section 29 that controls the entire printing unit 20. The printing control section 29 controls timing of feeding of each printing paper sheet by the paper feeding section 23, conveyance of each printing paper sheet by the paper conveyance section 24, ejection of ink from the ink head section 21, etc.

The printing system 1 of this embodiment is configured such that the printing conveyance speed can be set for each printing paper sheet. The printing conveyance speed for each printing paper sheet is determined depending on the maximum drop number of ink, the print resolution (dpi), etc., in printing performed on the printing paper sheet.

The printing control section 29 of this embodiment includes a maximum drop number table, as shown in FIG. 3, and a printing conveyance speed table, as shown in FIG. 4, which are set in advance.

The maximum drop number table shown in FIG. 3 is a table indicating a relationship between the type of printing paper sheet (such as plain paper, matt paper, or the like) and the maximum drop number. The maximum drop number refers to a maximum number of ink drops ejected from the ink head section 21 to form one pixel. A greater maximum drop number is set for a type of printing paper sheet that is less likely to have ink strike through.

The printing conveyance speed table shown in FIG. 4 is a table indicating a relationship among the maximum drop number, the print resolution, and the printing conveyance speed. The printing conveyance speed refers to a conveyance speed of each printing paper sheet conveyed by the conveying belt 25 during printing. The printing conveyance speed is set at a speed that allow printing with good image quality depending on the maximum drop number and the print resolution, which are settings relating to ink ejection operation during printing. Under the same print resolution, a lower printing conveyance speed is set for a greater maximum drop number. That is, in FIG. 4, $v5<v3<v1$, and $v6<v4<v2$. Further, a lower printing conveyance speed is set for a higher print resolution under the same maximum drop number. That is, $v2<v1$, $v4<v3$, and $v6<v5$.

The printing control section 29 generates drop data, which is data in a format corresponding to printing operation by the ink head section 21, from the print job data outputted from the computer 10. The drop data indicates the number of ink drops ejected from the ink head section 21 for each pixel. The printing control section 29 references the maximum drop number table shown in FIG. 3 based on the type of printing paper sheet set for each printing paper sheet to obtain the maximum drop number corresponding to the type of printing paper sheet, and generates the drop data based on the maximum drop number and the image data in the print job data. Also, the printing control section 29 references the printing conveyance speed table shown in FIG. 4 to set the printing conveyance speed for each printing paper sheet depending on the maximum drop number and the print resolution.

Then, in a case where printing is performed on a plurality of printing paper sheets, and the currently set printing conveyance speed differs from the printing conveyance speed set for the next and the following printing paper sheets to be conveyed, the printing control section 29 of this embodiment performs a printing suspending operation when the printing conveyance speed is changed. In the printing suspending operation, feeding of the next printing paper sheet to be subjected to printing is suspended, all printing paper sheets in the printing unit 20 are discharged from the printing unit 20, and the conveyance speed of the conveying belt 25 is changed by controlling the belt motor 26. It should be noted that, at this time, an operation to change the gap between the ink head section 21 and the conveying belt 25 may be performed depending on the type of printing paper sheet.

However, even when the currently set printing conveyance speed differs from the printing conveyance speed set for the next and the following printing paper sheets to be conveyed, the printing control section 29 does not change the printing conveyance speed for the next printing paper sheet to be conveyed if the entire printing operation time in a case where printing is performed with the printing conveyance speed initially set for the next and the following printing paper sheets to be conveyed is longer than the entire printing operation time in a case where the printing conveyance speed is not changed. That is, printing on the next printing paper sheet is performed without changing the currently set printing conveyance speed and performing the above-described printing suspending operation. How the printing conveyance speed is changed will be described in detail later.

The post-processing unit 30 includes: a post-processing control section 31 that controls the entire post-processing unit 30; a printed paper conveyance section 32 (which corresponds to a printed printing medium conveyance section) that receives each printed paper sheet discharged from the printing unit 20 and conveys the printed paper sheet so that given post-processing is performed on the printed paper sheet; and a post-processing section 33 that performs the given post-processing on the printed paper sheet conveyed by the printed paper conveyance section 32.

The post-processing control section 31 of this embodiment controls the conveyance speed (which will hereinafter be referred to as "post-processing conveyance speed") at the printed paper conveyance section 32 based on the relationship between the length of the printed paper sheet discharged from the printing unit 20 in the conveyance direction of the printed paper sheet and an inter-unit conveyance distance, which is set in advance, between the printing unit 20 and the post-processing unit 30. The inter-unit conveyance distance is set in advance at the post-processing control section 31. The inter-unit conveyance distance is, for example, a distance between the most downstream portion of the paper conveyance section 24 of the printing unit 20 and the most upstream portion of the printed paper conveyance section 32 of the post-processing unit 30. In this embodiment, the inter-unit conveyance distance is a distance L1 from the rear end portion of the conveying belt 25 of the printing unit 20 to receiving conveyance rollers 32*a* of the post-processing unit 30, as shown in FIG. 1.

Specifically, in a case where a length L2 of the printed paper sheet in the conveyance direction thereof is equal to or greater than the inter-unit conveyance distance L1, the post-processing control section 31 sets the conveyance speed (which will hereinafter be referred to as "post-processing conveyance speed") of the printed paper sheet by the printed paper conveyance section 32 at the same speed as the printing conveyance speed of the paper conveyance section 24 of the printing unit 20, so that the printed paper sheet discharged from the printing unit 20 is smoothly received by the printed paper conveyance section 32. That is, when printing is performed on a plurality of printing paper sheets and each printing paper sheet is discharged from the printing unit 20, the post-processing conveyance speed of the printed paper conveyance section 32 is controlled according to the printing conveyance speed set for each printing paper sheet.

It should be noted that, in this embodiment, the printed paper conveyance section 32 includes the receiving conveyance rollers 32*a* at the most upstream side thereof, and control is exerted such that the post-processing conveyance speed of the printed paper sheet at at least the conveyance roller 32*a* is the same as the printing conveyance speed. The post-processing conveyance speed after the trailing edge of the printed paper sheet is completely received by the post-processing unit 30 is set depending on the content of the post-processing and may not necessarily be the same as the printing conveyance speed.

On the other hand, in a case where the length L2 of the printed paper sheet in the conveyance direction thereof is smaller than the inter-unit conveyance distance L1, the post-processing control section 31 sets the post-processing conveyance speed of the printed paper conveyance section 32 at a conveyance speed that is set in advance irrespective of the printing conveyance speed at the printing unit 20. Specifically, in this embodiment, the post-processing conveyance speed is set at the same speed as the highest printing conveyance speed that can be set at the paper conveyance section 24 of the printing unit 20. It should be noted that, while the post-processing conveyance speed is set at the same speed as the highest printing conveyance speed in this embodiment, this is not intended to limit the invention. The post-processing conveyance speed may be different from the printing conveyance speed as long as it is higher than the printing conveyance speed for the printed paper sheet, and may arbitrarily be set by the user.

This is because that, in the case where the length L2 of the printed paper sheet in the conveyance direction thereof is smaller than the inter-unit conveyance distance L1, the leading edge of the printed paper sheet reaches the printed paper conveyance section 32 of the post-processing unit 30 after the trailing edge of the printed paper sheet has left the paper conveyance section 24 of the printing unit 20, and there is no moment at which the printed paper sheet is conveyed by both the printing unit 20 and the post-processing unit 30. Thus, the post-processing conveyance speed can be set irrespective of the printing conveyance speed at the printing unit 20.

Further, the post-processing control section 31 sets, based on the relationship between the length L2 of the printed paper sheet in the conveyance direction thereof and the inter-unit conveyance distance L1, whether or not to perform a post-processing suspending operation at the post-processing unit 30 along with the post-processing suspending operation at the printing unit 20 when the printing conveyance speed at the printing unit 20 is changed, as described above. In the post-processing suspending operation at the post-processing unit 30, all printing paper sheets in the post-processing unit 30 are discharged from the post-processing unit 30, and the post-processing conveyance speed at the receiving conveyance rollers 32*a* of the printed paper conveyance section 32 is changed according to the printing conveyance speed at the printing unit 20. It should be noted that, at this time, initialization processing, etc., for the post-processing may be performed.

Specifically, in the case where the length L2 of the printed paper sheet in the conveyance direction thereof is equal to or greater than the inter-unit conveyance distance L1, the post-processing conveyance speed is changed according to the change of the printing conveyance speed, as described above, and the post-processing control section 31 performs the post-processing suspending operation at the post-processing unit 30.

On the other hand, in the case where the length L2 of the printed paper sheet in the conveyance direction thereof is smaller than the inter-unit conveyance distance L1, the post-processing conveyance speed at the post-processing unit 30 is not changed, and the post-processing control section 31 continuously performs the post-processing with the post-processing conveyance speed kept at the same speed as the highest printing conveyance speed, without performing the post-processing suspending operation.

Next, operation of the printing system 1 of this embodiment is described with reference to the flow chart shown in FIG. 5. It should be noted that the printing system 1 of this embodiment is characterized by the control that is exerted when the printing conveyance speed for each printing paper sheet is changed, and now this point is mainly described.

First, the print job data including the image data, the type of printing paper sheet, etc., is generated on the computer 10 and outputted to the printing control section 29 of the printing unit 20.

The printing control section 29 expands the inputted print job data to generate the drop data for each printing paper sheet and obtain information of the printing conveyance speed set for each printing paper sheet, the type of printing paper sheet, etc., and then stores queue data indicating the presence of the drop data in a print reservation queue (S10, YES).

Then, when the queue data is stored in the print reservation queue, the printing control section 29 determines whether or not the first drop data in the print reservation queue is the first drop data from the start of printing (S12).

If the first drop data in the print reservation queue is the first drop data from the start of printing (S12, YES), the printing control section 29 also references the second and the following drop data in the print reservation queue and compares the printing conveyance speed set for the first printing paper sheet with the printing conveyance speeds set for the second and the following printing paper sheets. Then, if the printing conveyance speed set for the first printing paper sheet is higher than the printing conveyance speeds set for the second and the following printing paper sheets, the printing control section 29 determines whether to keep the initial setting of the printing conveyance speed for the first printing paper sheet (i.e., a printing conveyance speed that is initially set depending on the maximum drop number for each printing paper sheet and the print resolution) or to change setting of the printing conveyance speed to the lowest printing conveyance speed among the printing conveyance speeds set for the second and the following printing paper sheets. It should be noted that the case where the printing conveyance speed set for the first printing paper sheet is higher than the printing conveyance speeds set for the second and the following printing paper sheets means that printing can be achieved appropriately by delaying timing of ink ejection even when the printing conveyance speed for the first printing paper sheet is changed to the lowest printing conveyance speed among the printing conveyance speeds set for the second and the following printing paper sheets.

Specifically, if the printing conveyance speed set for the first printing paper sheet is higher than the printing conveyance speeds set for the second and the following printing paper sheets (S14, YES), the printing control section 29 calculates an estimated entire printing time Ta1 on the assumption that printing is performed with the printing conveyance speeds for all the printing paper sheets including the first printing paper sheet being set at the lowest printing conveyance speed among the printing conveyance speeds set for all the printing paper sheets, and an estimated entire printing time Ta2 on the assumption that printing is performed without changing initial settings of the printing conveyance speeds for all the printing paper sheets including the first printing paper sheet (S16). It should be noted that the estimated entire printing time Ta2 includes a time taken for the above-described printing suspending operation at the printing unit 20 along with change of the printing conveyance speed.

For example, if the printing conveyance speeds for the printing paper sheets includes v1 (mm/s) corresponding to a maximum drop number of 5 and a print resolution of 300 (dpi), and v3 (mm/s) corresponding to a maximum drop number of 6 and a print resolution of 300 (dpi), the estimated entire printing time Ta1 and the estimated entire printing time Ta2 are calculated as follows:

$$\text{Estimated entire printing time Ta1 (ms)}=(v3\times L+t1)\times(x+y), \text{ and}$$

$$\text{Estimated entire printing time Ta2 (ms)}=(v1\times L+t1)\times x+t2+(v3\times L+t1)\times y,$$

where L is a length of a printing paper sheet in the conveyance direction thereof, t1 is a time interval between printing paper sheets being conveyed, t2 is a time taken for the printing suspending operation at the printing unit 20, x is the number of printing paper sheets for which v1 is set as the printing conveyance speed, and y is the number of printing paper sheets for which v3 is set as the printing conveyance speed.

It should be noted that the above equations are one example, where the printing conveyance speed is changed once between v1 and v3 and the printing paper sheets have the same size. However, this is not intended to limit the invention, and there may be cases with other conditions, such that the printing conveyance speed is changed twice or more, the printing paper sheets have different sizes, etc. In such cases, Ta1 and Ta2 are calculated according to equations corresponding to each condition.

Then, the printing control section 29 compares Ta1 with Ta2. If Ta1>Ta2, the printing conveyance speed for the first printing paper sheet is not changed from the currently set printing conveyance speed (S18, YES). On the other hand, if Ta1>Ta2, the printing conveyance speed for the first printing paper sheet is set at the lowest printing conveyance speed among the printing conveyance speeds set for the second and the following printing paper sheets (S18, NO, S20).

Figure 6:
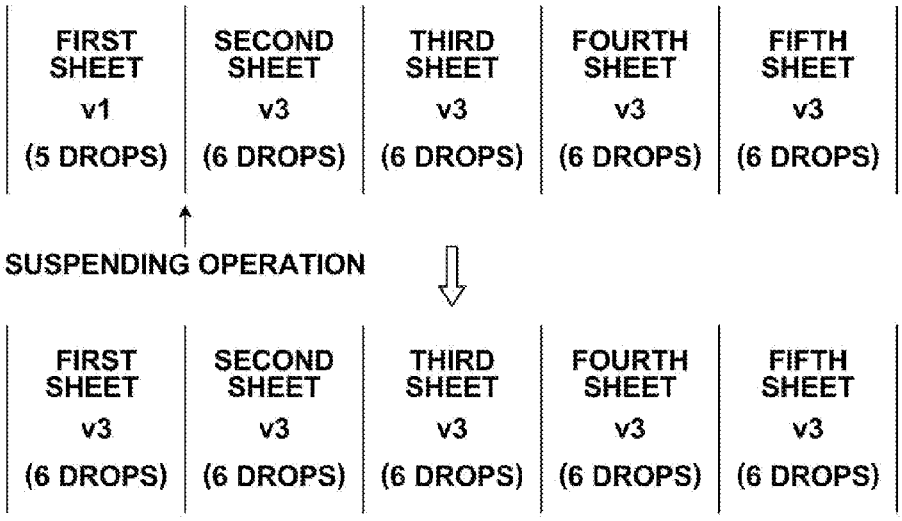
FIG. 6 is a diagram for explaining an effect of changing a printing conveyance speed set for the first printing paper sheet to the lowest printing conveyance speed among printing conveyance speeds for the second and the following printing paper sheets.

For example, in the case shown in FIG. 6 where the printing conveyance speed set for the first printing paper sheet is v1 and the printing conveyance speeds set for the second and the following printing paper sheets are continuously v3, setting the printing conveyance speed for the first printing paper sheet in the above-described manner allows omitting the printing suspending operation at the printing unit 20 by changing setting of the printing conveyance speed for the first printing paper sheet to v3, and this allows reducing the estimated entire printing time.

Then, the printing control section 29 obtains and outputs the length L2 of the first printed paper sheet in the conveyance direction thereof to the post-processing control section 31. The post-processing control section 31 sets the post-processing conveyance speed of the printed paper conveyance section 32 based on the relationship between the length L2 of the printed paper sheet in the conveyance direction thereof inputted thereto and the above-described inter-unit conveyance distance L1.

Specifically, if L1>L2, the post-processing conveyance speed of the printed paper conveyance section 32 is set at the same speed as the highest printing conveyance speed that can be set at the paper conveyance section 24 of the printing unit 20 (S24). On the other hand, if L1>L2, the post-processing conveyance speed of the printed paper conveyance section 32 is set at the same speed as the printing conveyance speed of the paper conveyance section 24 of the printing unit 20 (S26).

Then, printing is performed on the first printing paper sheet being conveyed at the printing conveyance speed that is set as described above, and given post-processing is performed on the printed paper sheet being conveyed at the post-processing conveyance speed that is set as described above. Then, the queue data corresponding to the printing paper sheet on which the printing has been performed is deleted from the print reservation queue.

Subsequently, the printing control section 29 checks whether or not there is queue data for the next printing paper sheet in the print reservation queue. If there is queue data for the second and the following printing paper sheets (S12, NO), the printing control section 29 checks whether or not the currently set printing conveyance speed differs from the next printing conveyance speed. If the currently set printing conveyance speed is the same as the next printing conveyance speed (S28, NO), setting of the printing conveyance speed is not changed and the process proceeds to S22, where a post-processing conveyance speed according to the length of the second and the following printing paper sheets in the conveyance direction thereof is set. In this case, the printing conveyance speed is not changed, and therefore the printing and the post-processing are performed without performing the printing suspending operation at the printing unit 20.

If it is determined in S28 that the currently set printing conveyance speed differs from the next printing conveyance speed, determination is made as to whether or not the currently set printing conveyance speed is not higher than the next and the following printing conveyance speeds (S30). That is, determination is made as to whether or not appropriate printing on the next and the following printing paper sheets can be achieved by delaying timing of ink ejection without changing the currently set printing conveyance speed.

If the currently set printing conveyance speed is not higher than the next and the following printing conveyance speeds (S30, YES), the printing control section 29 calculates an estimated entire printing time Tb1 (which corresponds to a first estimated entire printing time) on the assumption that printing is performed with the printing conveyance speeds for all the next and the following printing paper sheets being set at the same speed as the currently set printing conveyance speed, and an estimated entire printing time Tb2 (which corresponds to a second estimated entire printing time) on the assumption that printing is performed without changing the initial settings of the printing conveyance speeds set for the next and the following printing paper sheets (S32). It should be noted that the estimated entire printing times Tb1 and Tb2 can be calculated according to calculation formulae similar to those for calculating the above-described estimated entire printing times Ta1 and Ta2, for example.

Then, the printing control section 29 compares the estimated entire printing time Tb1 with the estimated entire printing time Tb2. If Tb1>Tb2, the initial setting of the printing conveyance speed for the next printing paper sheet is not changed (S36). That is, setting of the printing conveyance speed is changed from the currently set printing conveyance speed to the initial setting of the printing conveyance speed for the next printing paper sheet.

At this time, the printing suspending operation at the printing unit 20 is performed. With respect to the post-processing suspending operation at the post-processing unit 30, the post-processing control section 31 sets whether or not to perform the post-processing suspending operation along with the printing suspending operation at the printing unit 20 based on the relationship between the length L2 of the printed paper sheet in the conveyance direction thereof and the inter-unit conveyance distance L1, as described above.

Specifically, if the length L2 of the printed paper sheet in the conveyance direction thereof is equal to or greater than the inter-unit conveyance distance L1 (S38, NO), i.e., if there is a moment at which the leading edge of the printed paper sheet is conveyed by the post-processing unit 30 and the trailing edge of the printed paper sheet is conveyed by the printing unit 20 at the same time, it is necessary to change the post-processing conveyance speed according to the change of the printing conveyance speed, and the post-processing control section 31 performs the post-processing suspending operation at the post-processing unit 30 (S40).

On the other hand, if the length L2 of the printed paper sheet in the conveyance direction thereof is smaller than the inter-unit conveyance distance L1, there is no moment at which the leading edge of the printed paper sheet is conveyed by the post-processing unit 30 and the trailing edge of the printed paper sheet is conveyed by the printing unit 20 at the same time, and it is not necessary to change the post-processing conveyance speed at the post-processing unit 30. Then, the post-processing control section 31 continuously performs the post-processing with the post-processing conveyance speed kept at the same speed as the highest printing conveyance speed, without performing the post-processing suspending operation (S42).

On the other hand, if it is determined in S34 that Tb1>Tb2, the printing conveyance speed of the next printing paper sheet is set at the same speed as the currently set printing conveyance speed. That is, the printing conveyance speed is not changed from the current printing conveyance speed to the printing conveyance speed set for the next printing paper sheet. Then, the second and the following post-processing conveyance speeds are set by the operations in S22 to S26. In this case, the printing conveyance speed is not changed, and therefore the printing and the post-processing are performed without performing the printing suspending operation at the printing unit 20.

On the other hand, if it is determined in S30 that the currently set printing conveyance speed is higher than the next and the following printing conveyance speeds (S30, NO), printing on the next and the following printing paper sheets cannot be achieved appropriately with the currently set printing conveyance speed, and therefore the printing conveyance speed is changed to the initial settings of the printing conveyance speeds for the next and the following printing paper sheets (S36). Then, determination as to whether or not to perform the post-processing suspending operation at the post-processing unit 30 is made by the operations in S38 to S42, and the subsequent printing and post-processing are performed.

The above-described operations are repeated until there is no queue data in the print reservation queue. When there is no queue data in the print reservation queue (S10, NO), the process ends.

According to the printing system of the above-described embodiment, when the printing conveyance speed at the printing unit 20 is changed, the post-processing suspending operation is not performed if the length of the printing paper sheet in the conveyance direction thereof is smaller than the inter-unit conveyance distance, and the post-processing suspending operation is performed if the length of the printing paper sheet in the conveyance direction thereof is equal to or greater than the inter-unit conveyance distance. This allows omitting the post-processing suspending operation depending on the length of the printing paper sheet in the conveyance direction thereof, thereby improving productivity.

Further, in the above-described printing system of the invention, if the printing conveyance speed for the currently set printing paper sheet differs from the printing conveyance speed set for the next printing paper sheet to be conveyed, comparison may be made between the first estimated entire printing time Tb1, which is estimated on the assumption that the printing conveyance speed for the next and the following printing paper sheets to be conveyed is not changed from the printing conveyance speed for the currently set printing paper sheet, and the second estimated entire printing time Tb2 including a time taken for the printing suspending operation, which is estimated on the assumption that the printing conveyance speed for the next and the following printing paper sheets to be conveyed is changed from the printing conveyance speed for the currently set printing paper sheet. Then, the printing suspending operation may be performed if the second estimated entire printing time Tb2 is smaller than the first estimated entire printing time Tb1, and the printing suspending operation may not be performed and printing conveyance speed may not be changed from the printing conveyance speed for the currently set printing paper sheet if the first estimated entire printing time Tb1 is equal to or smaller than the second estimated entire printing time Tb2. In this case, further reduction of the entire processing time can achieved.

Further, the post-processing conveyance speed may be set at the same speed as the printing conveyance speed if the length of the printing paper sheet in the conveyance direction thereof is equal to or greater than the inter-unit conveyance distance, and the post-processing conveyance speed may be set at a higher speed than the printing conveyance speed for the printing paper sheet if the length of the printing paper sheet in the conveyance direction thereof is smaller than the inter-unit conveyance distance. In this case, speed-up of the post-processing can be achieved, thereby achieving further reduction of the entire processing time.

What is claimed is:

1. A printing system comprising a printing unit and a post-processing unit, the printing unit comprising:

a feeding section that feeds a printing medium;

a printing medium conveyance section that receives and conveys the printing medium fed by the feeding section;

a printing section that performs printing on the printing medium conveyed by the printing medium conveyance section; and a printing control section that controls the printing medium conveyance section such that each printing medium is conveyed at a printing conveyance speed set for each printing medium, and performs, when the printing conveyance speed is changed, a printing suspending operation to suspend feeding of the printing medium from the feeding section, to discharge an already fed printing medium, and to change setting of the printing conveyance speed, the post-processing unit comprising:

a printed printing medium conveyance section that receives and conveys a printed printing medium having been subjected to the printing;

a post-processing section that performs given post-processing on the printed printing medium conveyed by the printed printing medium conveyance section; and a post-processing control section that controls a post-processing conveyance speed of the printed printing medium conveyance section such that the printed printing medium is received by the printed printing medium conveyance section at the same speed as the printing conveyance speed at the printing unit, and performs, when the printing conveyance speed at the printing unit is changed, a post-processing suspending operation to discharge the printed printing medium and to change setting of the post-processing conveyance speed, wherein, when the printing conveyance speed at the printing unit is changed, the post-processing control section does not perform the post-processing suspending operation if a length of the printing medium in a conveyance direction thereof is smaller than an inter-unit conveyance distance, which is set in advance, between the printing unit and the post-processing unit, and the post-processing control section performs the post-processing suspending operation if the length of the printing medium in the conveyance direction thereof is equal to or greater than the inter-unit conveyance distance.

2. The printing system as claimed in claim 1, wherein, if the printing conveyance speed for a currently set printing medium differs from the printing conveyance speed set for a next printing medium to be conveyed, the printing control section compares a first estimated entire printing time, which is estimated on the assumption that the printing conveyance speed for the next and the following printing media to be conveyed is not changed from the printing conveyance speed for the currently set printing medium, with a second estimated entire printing time including a time taken for the printing suspending operation, which is estimated on the assumption that the printing conveyance speed for the next and the following printing media to be conveyed is changed from the printing conveyance speed for the currently set printing medium, and the printing control section performs the printing suspending operation if the second estimated entire printing time is smaller than the first estimated entire printing time, and the printing control section does not perform the printing suspending operation and does not change the printing conveyance speed from the printing conveyance speed for the currently set printing medium if the first estimated entire printing time is not greater than the second estimated entire printing time.

3. The printing system as claimed in claim 2, wherein, if the length of the printing medium in the conveyance direction thereof is equal to or greater than the inter-unit conveyance distance, the post-processing control section sets the post-processing conveyance speed at the same speed as the printing conveyance speed, and if the length of the printing medium in the conveyance direction thereof is smaller than the inter-unit conveyance distance, the post-processing control section sets the post-processing conveyance speed at a speed higher than the printing conveyance speed set for the printing medium.

4. The printing system as claimed in claim 3, wherein, if the length of the printing medium in the conveyance direction thereof is smaller than the inter-unit conveyance distance, the post-processing control section sets the post-processing conveyance speed at the same speed as a highest printing conveyance speed that can be set at the printing medium conveyance section.

5. The printing system as claimed in claim 1, wherein, if the length of the printing medium in the conveyance direction thereof is equal to or greater than the inter-unit conveyance distance, the post-processing control section sets the post-processing conveyance speed at the same speed as the printing conveyance speed, and if the length of the printing medium in the conveyance direction thereof is smaller than the inter-unit conveyance distance, the post-processing control section sets the post-processing conveyance speed at a speed higher than the printing conveyance speed set for the printing medium.

6. The printing system as claimed in claim 5, wherein, if the length of the printing medium in the conveyance direction thereof is smaller than the inter-unit conveyance distance, the post-processing control section sets the post-processing conveyance speed at the same speed as a highest printing conveyance speed that can be set at the printing medium conveyance section.

* * * * *